US012480314B2

(12) United States Patent
Ardern

(10) Patent No.: US 12,480,314 B2
(45) Date of Patent: Nov. 25, 2025

(54) PANEL CONNECTION

(71) Applicant: Fergus Jonathan Ardern, Lingwood (GB)

(72) Inventor: Fergus Jonathan Ardern, Lingwood (GB)

( * ) Notice: Subject to any disclaimer, the term of this patent is extended or adjusted under 35 U.S.C. 154(b) by 285 days.

(21) Appl. No.: 17/964,722

(22) Filed: Oct. 12, 2022

(65) Prior Publication Data

US 2023/0124128 A1 Apr. 20, 2023

(30) Foreign Application Priority Data

Oct. 19, 2021 (GB) ..... 2114912

(51) Int. Cl.
*E04F 15/02* (2006.01)

(52) U.S. Cl.
CPC ..... *E04F 15/02* (2013.01); *E04F 2201/0115* (2013.01); *E04F 2201/096* (2013.01)

(58) Field of Classification Search
CPC ..... E04F 15/02; E04F 15/02005; E04F 15/02011; E04F 15/02016; E04F 15/02022; E04F 15/02033; E04F 15/02038; E04F 15/02077; E04F 15/02088; E04F 15/02094; E04F 2015/02122; E04F 2015/02183; E01C 9/086; E01C 5/20; E01C 13/02; E01C 3/006; E01C 13/08
See application file for complete search history.

(56) References Cited

U.S. PATENT DOCUMENTS 6,189,289 B1 * 2/2001 Quaglia ..... E04F 15/024 52/220.1
6,722,831 B2 * 4/2004 Rogers ..... F16B 21/02 411/553
7,516,587 B2 * 4/2009 Barlow ..... E04F 15/105 52/177
7,955,025 B2 * 6/2011 Murphy ..... E01C 5/20 404/35
7,980,042 B2 * 7/2011 Polk, Jr. ..... B29C 31/047 403/252
8,656,662 B2 * 2/2014 Moller, Jr. ..... E04F 15/10 52/177
D720,437 S * 12/2014 Togawa ..... D23/261
9,206,559 B2 * 12/2015 Bach ..... E01C 5/20
9,986,693 B2 * 6/2018 van Raam ..... A01G 9/1423
(Continued)

FOREIGN PATENT DOCUMENTS

CN 207537833 U 6/2018
EP 0614017 A2 9/1994
(Continued)

*Primary Examiner* — Timothy D Collins
(74) *Attorney, Agent, or Firm* — Bradley Arant Boult Cummings LLP

(57) ABSTRACT

A connection between substantially planar panels is disclosed. A panel comprises a panel body, said panel body comprising a pair of planar members, deployed in parallel spaced arrangement, and connected by an outer side wall. A connection assembly extends circumferentially from each panel body, with a connection assembly including a planar connection surface for engaging in a plane a corresponding connection surface on a second panel. The planar connection surface and the side wall defining an acute angle, wherein said plane is at an angle of 2°-8° to the plane of the panel bodies.

9 Claims, 3 Drawing Sheets

(56) References Cited

U.S. PATENT DOCUMENTS

| | | | | |
|---|---|---|---|---|
| 10,145,124 | B2 * | 12/2018 | Tosolini | E01C 5/005 |
| 10,238,084 | B2 * | 3/2019 | van Raam | A01K 1/0151 |
| 10,718,122 | B2 * | 7/2020 | Gooden | E03F 1/002 |
| 10,731,303 | B2 * | 8/2020 | Lingle | E01C 11/225 |
| 10,842,303 | B1 * | 11/2020 | Vieveen | A47G 27/0218 |
| 10,844,552 | B2 * | 11/2020 | van Raam | E01C 13/08 |
| 10,912,443 | B1 * | 2/2021 | Neill | B32B 3/266 |
| 2003/0190969 | A1 * | 10/2003 | Barlow | E04F 15/10 473/157 |
| 2004/0223828 | A1 | 11/2004 | Lazaruk et al. | |
| 2007/0223993 | A1 * | 9/2007 | Peterson | E01C 5/005 403/364 |
| 2014/0270945 | A1 * | 9/2014 | Bach | E01C 9/086 404/36 |
| 2017/0107725 | A1 * | 4/2017 | Jones | E04F 15/02033 |
| 2018/0030666 | A1 * | 2/2018 | Penland, Jr. | E01C 5/18 |
| 2019/0119862 | A1 * | 4/2019 | Penland, Jr. | E01C 5/18 |
| 2019/0257093 | A1 * | 8/2019 | Polk, Jr. | F16B 41/002 |
| 2019/0261533 | A1 * | 8/2019 | Latino | H05K 7/20745 |

FOREIGN PATENT DOCUMENTS

| | | | |
|---|---|---|---|
| GB | 2428432 | A | 1/2007 |
| WO | WO-200166875 | A1 | 9/2001 |
| WO | WO-2003083234 | A1 | 10/2003 |
| WO | WO-2005035874 | A1 | 4/2005 |
| WO | WO-2007010195 | A1 | 1/2007 |

* cited by examiner

PANEL CONNECTION

FIELD OF THE INVENTION

The present invention relates to a releasable connection means for connecting neighbouring surface-covering panels to form a planar floor array. The connection means acts to increase the resistance towards separation of conjoined panels

BACKGROUND TO THE INVENTION

Surface panels are widely used both to protect a surface and also to enable a surface to be used for a purpose for which it would otherwise be unsuitable. Typically, a plurality of panels, is assembled together into a planar array. The planar array then provides a surface on which people or vehicles can move. As examples of uses to which such an array can be put, can be cited for use as a roadway or for taxiing aircraft. Also, the pitch in a sports stadium or the like can be converted into an arena for a concert so that the turf is not damaged.

An important feature of an array of panels is the connection means between individual panels. The connection needs to be able to withstand downwardly directed forces as well as turning forces. A wide variety of connections is known in the art. The type of connection with which the current invention is concerned utilises a series of connectors which connect together connection assemblies around the edges of the body of each panel and usually integral with said panel body. Such a connection usually allows the connection to flex to a limited extent, which enables forces to dissipate. Examples of surface panels which interconnect at their edges to form a planar array may be found in the following patent and application, GB 2428432 and WO2007/010195.

A problem with such connections is to provide strength in a direction parallel to the plane of the array formed which acts to pull the panels apart. The current invention seeks to provide a connection which addresses this problem.

SUMMARY OF THE INVENTION

According to a first aspect of the invention there is provided a connection between substantially planar panels, a panel comprising a panel body, said panel body comprising a pair of planar members, deployed in parallel spaced arrangement, and connected by an outer side wall;

a connection assembly extending circumferentially from each panel body, a connection assembly including a planar connection surface for engaging in a plane a corresponding connection surface on a second panel, the planar connection surface and the side wall defining an acute angle, wherein said plane is at an angle of 2°-8° to the plane of the panel bodies.

This provides increased resistance to separation of the panels.

Preferably, an upper connection assembly includes one or more throughapertures to receive a connecting plug, the lower connection assembly including one or more throughapertures to receive a plug receiver, connection of the connecting plug to the plug receiver acting to secure the panels together, the connection assemblies meeting in a plane.

Preferably the connecting plug secures to the plug receiver by means of a snap-fit connection. This enables rapid assembly of a connection.

Optionally, a connection assembly has a proximal portion adjacent the panel body, which is thinner in section than a portion distal the panel body.

According to a second aspect of the invention, there is provided a panel, the panel comprising a panel body, said panel body comprising a pair of planar members, deployed in parallel spaced arrangement, and connected by an outer side wall;

and extending circumferentially from the upper portion thereof, a connection assembly;

the connection assembly including a planar connection surface for engaging in a plane a corresponding connection surface on a second panel, the planar connection surface and the side wall defining an acute angle;

wherein said plane is at an angle of 2°-8° to the plane of the panel bodies.

Preferably, the connection assembly includes one or more throughapertures to receive a connecting plug.

Alternatively, a connection assembly includes one or more throughapertures to receive a plug receiver, connection of a connecting plug to the plug receiver acting to secure panels together.

BRIEF DESCRIPTION OF THE FIGURES

The invention is now described with respect to the accompanying drawings which show by way of example only, one embodiment of a connection means. In the drawings.

DETAILED DESCRIPTION OF THE INVENTION

The provision of a covering of surface panels over a particular surface, in order to protect that surface, is well known in the art. The surface might be required for use for widely different, typically temporary purposes such as, for example, a concert venue or to serve as a temporary runway. The coverage is carried out for a number of reasons. First, there is often a desire to protect the surface against damage where the use is not the normal one. Second, there may be a requirement to allow the area of the surface to be used for a purpose for which it would otherwise be unsuitable.

Figure 1:
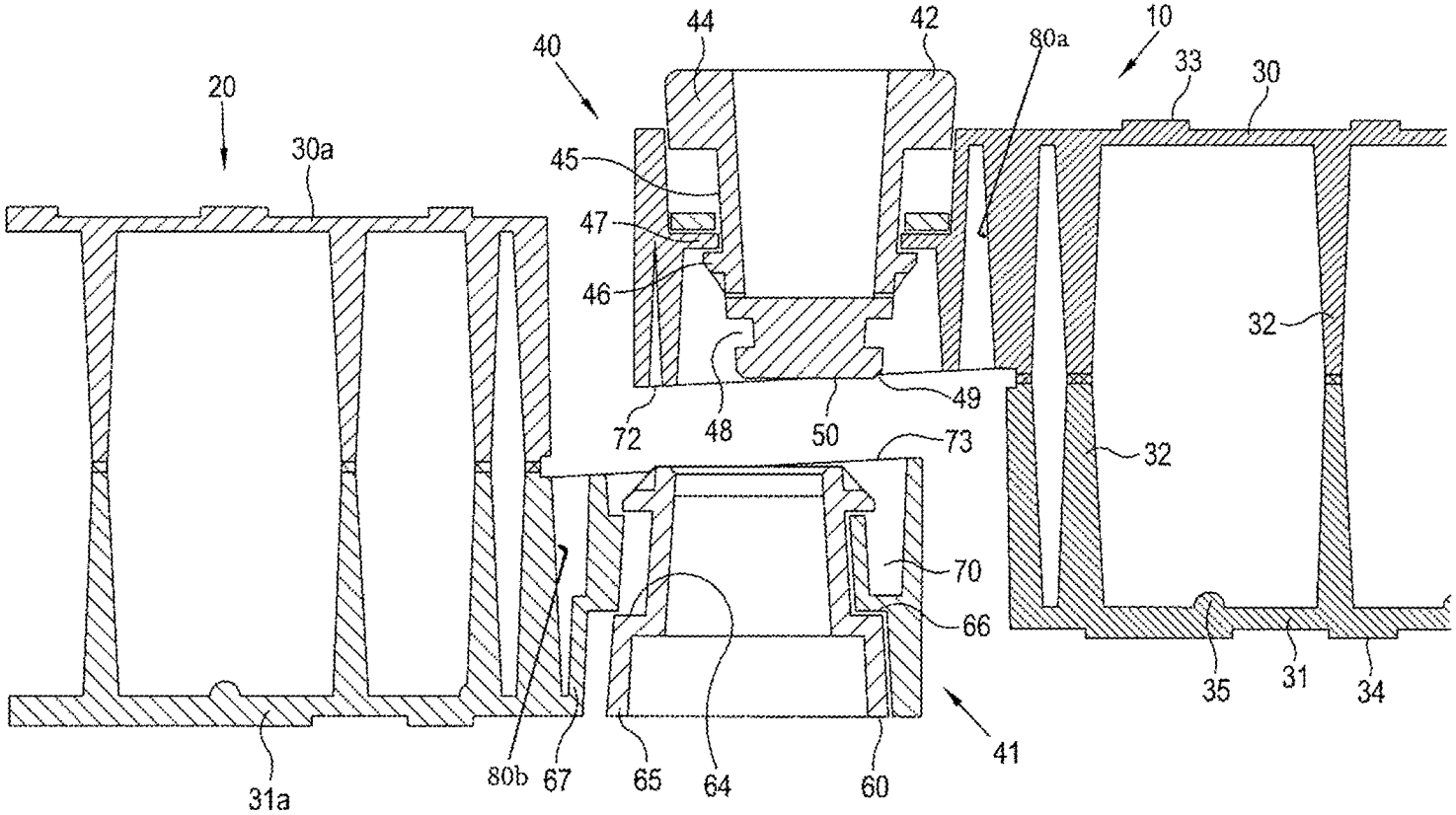
FIG. 1 shows a cross-sectional view of two separated surface panels, in which one panel has a raised locking member.
Figure 2:
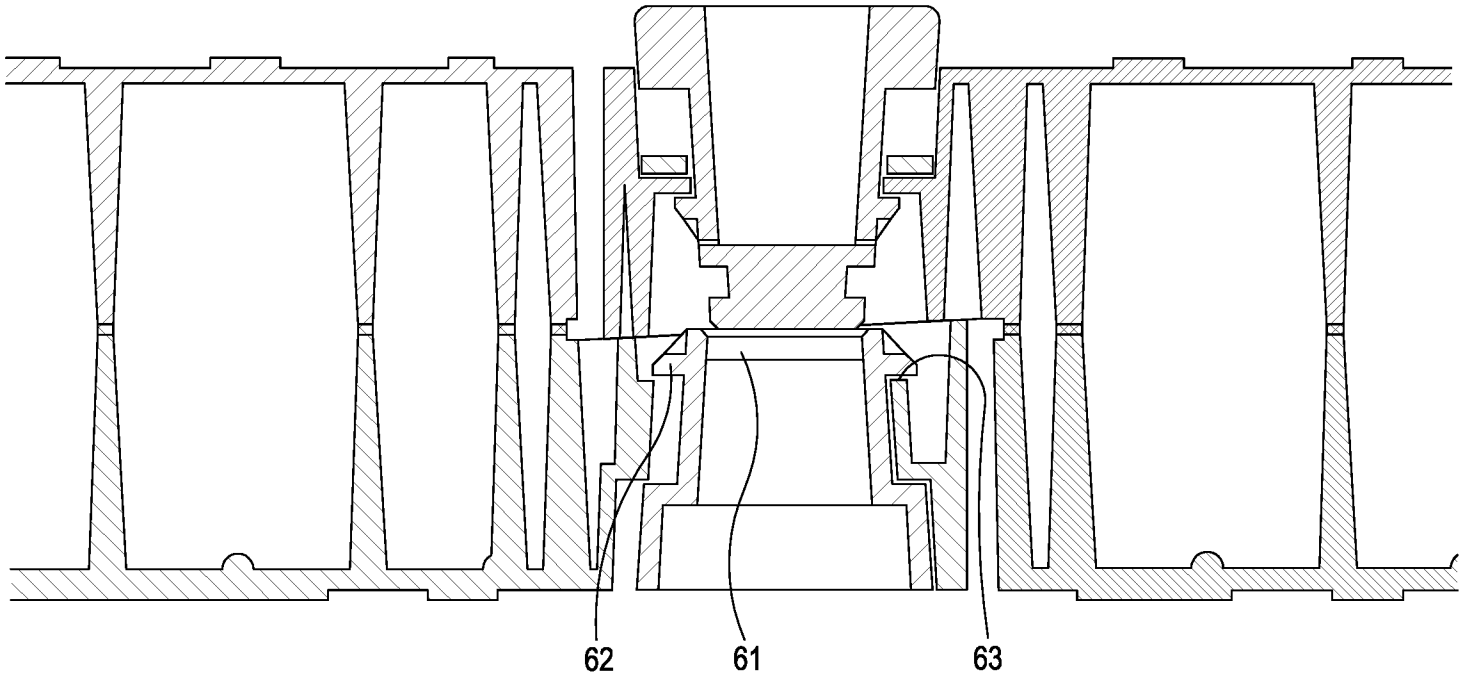
FIG. 2 shows a cross-sectional view of the two abutting surface panels of FIG. 1, in which the joining elements are engaged.

FIG. 1 shows a cross-sectional view of two surface panels 10 and 20, which are to be assembled together, and also to other like panels to form a usable surface. The panel 10 has an in-use upper planar member 30 and an in-use lower planar member 31, spaced apart from the upper planar member 30, the planar members deployed parallel to each other. The panel 20 is similarly constructed having upper and lower planar members 30*a*, 31*a*. The planar members 30, 31 are separated by an array of supports 32 which in the exemplified embodiment are deployed perpendicularly to the inner surfaces of the planar members 30, 31. The supports 32 act to provide strength to a panel when a panel is supporting a load by distributing the forces, which are primarily directed across the planar members 30, 31, so that the panel can withstand the forces. The internal structure can be selected from those known in the art to impart stability to a panel. A central supporting rib 35 is located on the inner surface of lower planar member 31 to add further strength to the panel.

The upper planar member 30 has a ridge 33 on the outer surface of the upper planar member 30, which in use forms part of a tread pattern for a first non-slip surface. The lower planar member 31 has a ridge 34 on the outer surface of the lower planar member 31, which in use provides a grip pattern for a second non-slip surface, and which aids in keeping the panel 10 in a stable position with respect to the surface on which the panel 10 rests.

Extending from the outer edge of the panel 10 is an upper connection assembly 40, which extends at least partially around the circumference of the panel 10, and connects in-use with a corresponding lower connection assembly 41 on the neighbouring panel 20 to hold the panels 10, 20 together. The thickness of the upper connection assembly 40 in the illustrated embodiment is about half of the thickness of the panel 10, with the connection assembly 40 extending from the upper half of the panel 10. The thickness of the lower connection assembly 41 has a similar relationship to the panel 20 and extends from the lower half of the panel 20.

The internal structure of a connection assembly is for the most part, similar to that of the main body of the panel to which the connection assembly is attached. However, at spaced intervals along the connection assembly, apertures are provided for either a connection plug or a plug receiver to be inserted. A connection plug connects with a corresponding plug receiver to hold the two panels together. It is important that the connection between two neighbouring panels be a strong one as the connection regions have not only to withstand the downward force from the load on the panel, but also turning forces when different loads are applied to neighbouring connected panels.

In more detail, and with reference initially to FIG. 1, a plug 42 is inserted into an aperture 43 in the connection assembly 40. The plug 42 is hollow to reduce weight. The general cross-section of the plug 42 is circular, with a narrowing taper towards the distal end along the length of the plug 42. The head 44 of the plug 42 facilitates the application of pressure to insert the plug 42 into the connection assembly 40 and also enables the plug 42 to fill the aperture 43. Part way along the length of the tapered portion 45 of the plug 42, is located a flange 46. The flange element 46 is formed of a resilient material so that the flange 46 can pass through the narrower gap formed in a retaining element 47. Once the flange 46 has passed through the gap, the flange 46 and retaining element 47 co-operate together to resist removal of the plug 42.

Figure 3:
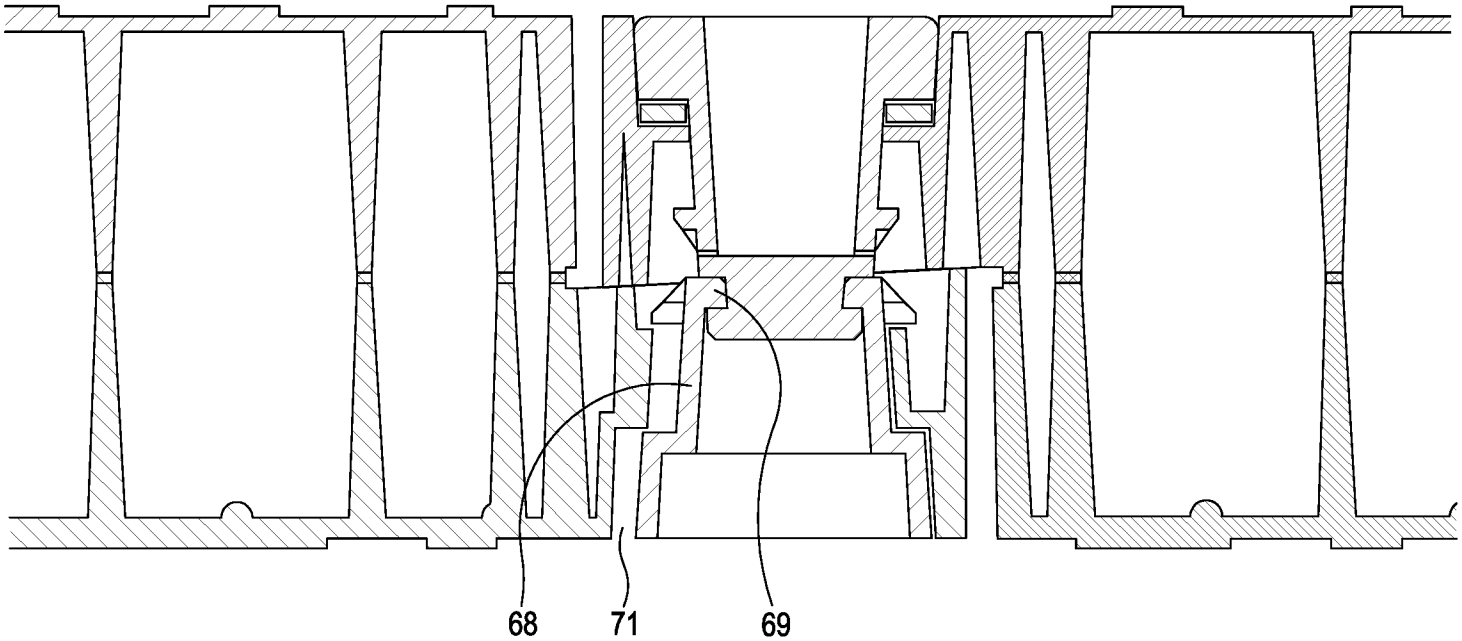
FIG. 3 shows a cross-sectional view of two abutting surface panels, in which the two panels of FIG. 1 are secured together.

At the end of the plug 42 distal to the head 44, an annular groove 48 is provided. As can be seen in FIG. 3, on securing the panels 10, 20 together, the plug 42 is pushed into a female plug receiver 60 housed within a receiving aperture 70 in the connection assembly 41. The plug 42 has an annular bevelled edge 49 located about the bottom surface 50 of the plug 42, which bevelled edge 49 facilitates the insertion of the plug 42 into a receiving aperture 61 in the female plug receiver 60.

The female plug receiver 60, located in the receiving aperture 70 within the connection assembly 41, is retained within the panel 20 by engagement of a flange 62 which cooperates with a retaining surface 63. The movement of the female plug receiver 60 into the receiving aperture 70 along a vertical axis in a direction into the connection assembly 41 is limited by the engagement of the surface 64 of the leg 65 with the surface 66 of the arm 67 of the connection assembly 41.

The entrance to the female plug receiver 60 comprises an annulus 69 formed of resilient material or mounted for movement on resilient support walls 68. This allows the gap provided by the annulus 69 to open to allow the head of the plug 42 to pass through. Once the plug 42 is sufficiently inserted, the annulus 69 is located within the groove 48, by virtue of the resilience of the material from which the annulus 69 is formed. The engagement of the annulus 69 in the groove 48 holds the plug 42 in position thus securing the panels 10, 20 together. A gap 71 in the aperture of the surface panel 20, allows the lateral movement of the female plug receiver 60 in relation to the panel 20 on insertion of the plug 42.

Other means to secure the panels 10, 20 together, known in the art can be used without departing from the spirit of the invention.

In order to increase the resistance to separation of neighbouring connected panels and also to better distribute the loads within the connection region, the upper and lower connection assemblies 40, 41 engage across a sloping plane, rather than a horizontal plane, parallel to the planar member 30, 31. To achieve this the lower surface 72 of the upper connection assembly 40 slopes downwardly from the panel 10 forming an acute angle with respect to the plane of the panels 10, 20, such that the connection assembly 40 is, in effect, thinner at the region proximal to the panel 10 than the region distal to the panel 10. Conversely, the lower connection assembly 41 slopes upwardly from the panel 20, again forming an acute angle with respect to the plane of the panels 10, 20, such that the connection assembly 41 is, in effect, thinner at the region proximal to the panel 20 than the region distal to the panel 20. In order to provide a useful effect, it has been found that the angle made by the plane joining the lower surface 72 of the upper connection assembly 40 and the upper surface 73 of the lower connection assembly 41 should be greater than 2° to the plane of the panels 10, 20. Further the slope should be less than 8° to avoid weakening the connection between a connection assembly and the panel to which it is connected.

Without being bound by theory, it is believed that the sloping surface acts in two ways to improve the performance of assembled panels. First, it should be recognised that the connection between adjacent panels is not a rigid one, but allows for a small amount of relative movement. A different load applied to adjacent panels will therefore produce a small change in orientation of one panel relative to a neighbour. Any turning forces acting on the joint between the connection assemblies will therefore more readily be acting in a direction closer to the perpendicular direction to the plane joining the connection assemblies 40, 41. The energy is therefore more efficiently absorbed. Second, the sloping plane acts to better resist any tension forces acting, in the plane of the panels, to pull neighbouring panels apart. Part of the tension force will act into the surfaces 72, 73 rather than across the surfaces 72, 73. Additionally, it is believed that the sloping plane acts to improve the performance of the assembled panels when subject to a rolling load such as imparted by a vehicle. As the wheels of the vehicle roll from one panel onto the next, the sloping surface of the connection transfers the load from a region directly under the wheel to one ahead of the wheel, and also behind the wheel. The stress on the connection is therefore spread laterally, in the plane of the panel, and into the edges of the connection assembly.

The invention claimed is:

1. A connection between first and second substantially planar panels, the first panel comprising:

a first panel body, and the second panel a second panel body, each panel body comprising a pair of planar members, deployed in parallel spaced arrangement, and connected by an array of supports;

the first planar panel body having an upper connection assembly extending circumferentially from the first panel body;

the upper connection assembly including a lower planar connection surface sloping downwardly from the first panel body;

the second planar panel body having a lower connection assembly extending circumferentially from the second panel body; the lower connection assembly including an upper planar connection surface sloping upwardly from the second panel body, the lower and upper planar connection surfaces engaging in a plane, the planar connection surfaces and a side wall defining an acute angle; and such that each connection assembly is thinner in section in the region proximal the panel body than the region distal the panel body, wherein the plane is at an angle of 2°-8° to the plane of the respective panel body.

2. The connection according to claim 1, wherein the upper connection assembly of the first panel includes one or more throughapertures to receive a connecting plug, the lower connection assembly of the second panel including one or more throughapertures to receive a plug receiver, connection of the connecting plug to the plug receiver acting to secure the panels together, the connection assemblies meeting in a plane.

3. The connection according to claim 2, wherein the connecting plug secures to the plug receiver by means of a snap-fit connection.

4. A first panel, the first panel comprising a first panel body, the first panel body comprising a pair of planar members, deployed in parallel spaced arrangement, and connected by an array of supports;

and extending circumferentially from the upper portion thereof, an upper connection assembly;

the upper connection assembly including a lower planar connection surface sloping downwardly from the first panel body, for engaging in a plane a corresponding connection surface on a second panel, the planar connection surface and a side wall defining an acute angle; and such that the upper connection assembly is thinner in section in the region proximal the first panel body than the region distal the first panel body, wherein the plane is at an angle of 2°-8° to the plane of the panel bodies.

5. The first panel according to claim 4, wherein the upper connection assembly includes one or more throughapertures to receive a connecting plug.

6. The first panel according to claim 4, wherein the upper connection assembly includes one or more throughapertures to receive a plug receiver, connection of a connecting plug to the plug receiver acting to secure panels together.

7. A second panel, the second panel comprising a second panel body, the second panel body comprising a pair of planar members, deployed in parallel spaced arrangement, and connected by an array of supports;

and extending circumferentially from the lower portion thereof, a lower connection assembly;

the lower connection assembly including an upper planar connection surface sloping upwardly from the second panel body, for engaging in a plane a corresponding connection surface on a first panel, the planar connection surface and a side wall defining an acute angle; and such that the lower connection assembly is thinner in section in the region proximal the second panel body than the region distal the second panel body, wherein the plane is at an angle of 2°-8° to the plane of the panel bodies.

8. The second panel according to claim 7, wherein the lower connection assembly includes one or more throughapertures to receive a connecting plug.

9. The second panel according to claim 7, wherein the lower connection assembly includes one or more throughapertures to receive a plug receiver, connection of a connecting plug to the plug receiver acting to secure panels together.

* * * * *